United States Patent [19]

Valek et al.

[11] 4,051,707

[45] Oct. 4, 1977

[54] METHOD AND APPARATUS FOR MAKING DRAWN CONTAINERS

[75] Inventors: John Valek, Cicero; Roland E. Miller, Orangeville; Joseph A. Scaletta, Mount Prospect, all of Ill.

[73] Assignee: Kraft, Inc., Glenview, Ill.

[21] Appl. No.: 654,985

[22] Filed: Feb. 2, 1976

[51] Int. Cl.[2] ..... B21D 22/24

[52] U.S. Cl. ..... 72/348; 113/120 H

[58] Field of Search ..... 72/347, 348, 349; 113/120 R, 120 G, 120 H

[56] References Cited

U.S. PATENT DOCUMENTS

| | | | |
|---|---|---|---|
| 2,739,557 | 3/1956 | Staubitz | 72/349 X |
| 2,968,270 | 1/1961 | McChesney | 113/120 R |
| 3,163,142 | 12/1964 | Buhrke | 113/120 G |
| 3,312,098 | 4/1967 | Henrickson | 72/349 X |
| 3,496,896 | 2/1970 | Smith | 113/120 G |
| 3,678,725 | 7/1972 | Langewis | 72/348 X |
| 3,786,667 | 1/1974 | Garnett | 72/348 |

*Primary Examiner*—Robert Louis Spruill
*Attorney, Agent, or Firm*—Fitch, Even, Tabin & Luedeka

[57] ABSTRACT

A method and apparatus for forming a drawn container from a metallic blank are disclosed wherein the blank is drawn over the outer surface of a stationary forming ring by an annular forming die to form a tubular wall portion which is thereafter completely redrawn by a forming punch in co-operation with a forming die, a reverse redrawn annular wall portion of the blank being positioned for engagement by a curling ring to form an inwardly curled rim at the peripheral edge of the open end of the container.

10 Claims, 10 Drawing Figures

METHOD AND APPARATUS FOR MAKING DRAWN CONTAINERS

Figure 1:
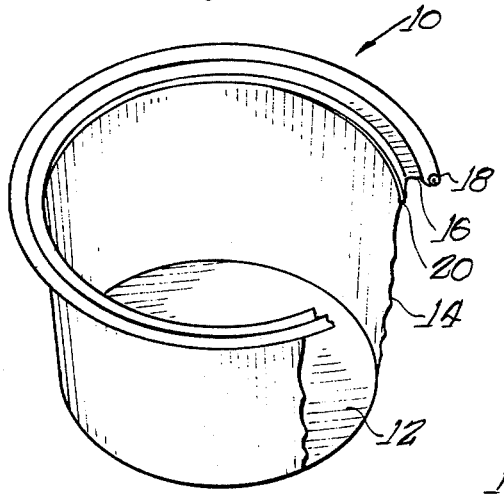

The present invention relates generally to methods and apparatus for forming containers from metallic blanks, and more particularly to a method and apparatus for forming a container by draw-reverse drawing a blank such that the upper surface of the blank forms the interior surface of the resulting container and an inwardly curled bead is formed at the peripheral edge of the open end of the container.

In recent years, it has become a practice in the marketing of consumer goods such as many types of edible food products and the like to package the goods in containers having removable resealable lids. The containers are frequently made from lightweight thin metal stock, such as aluminum, aluminum alloy, reduced tin plate, double drawn steel and other lightweight materials. The containers may be made by drawing blanks of the selected thin metal material and generally have improved strength characteristics over thin walled paper or pulp type containers. The thin metallic drawn containers are conventionally formed with a rim adjacent the open end of the container which may take the shape of a curled or rolled bead. The peripheral curled bead provides increased strength for the upper edge of the container and facilitates sealing of a lid onto the container.

One process for forming such containers, and particularly such containers generally referred to as "deep drawn" containers, is commonly known as the "draw-reverse draw" process. In accordance with this process of making containers, a blank is first drawn over an exterior surface of a die during a first draw to form a peripheral tubular wall, and a punch or drawing die is brought into cooperation with a female forming die surface during a second draw to form the central portion of the blank into the desired interior container configuration simultaneously with at least partial redrawal of the first drawn peripheral tubular wall. After the second or reverse drawing operation, a curled rim or bead may be formed peripherally of the open end of the container to provide added strength and establish a sealing rim to receive the lid of the container thereover.

One apparatus and method for producing drawn containers is disclosed in U.S. Pat. No. 3,695,084, dated Oct. 3, 1972. The apparatus and method disclosed in this patent have a significant drawback in that the depth of the container produced in accordance with the patent disclosure is limited by the outer diameter of the planar annular top flange, designated at 13 in the patent drawings. More particularly, it is known that in drawing blanks of material, such as sheet metal stock, the percentage reduction which may be effected for each successive draw is limited. The percentage reduction to which a blank may be drawn during the first draw is expressed as a percentage of the diameter of the initial undrawn blank. The limit of each successive draw is expressed as a percentage of the diameter following the next preceding draw. One textual source, for example, suggests that for a blank having a diameter D, the first reduction should not exceed approximately 42 percent of D, and the second draw should not exceed approximately 25 percent of the diameter resulting after the first draw. If the percentage limits of reduction are exceeded, the blank may fracture, become undesirably thin and nonuniform, or exhibit severe wrinkling. Thus, in respect to the aforenoted U.S. Pat. No. 3,695,084, the outer diameter of the annular flange 13 dictates the permissible diameter of the outer forming surface 55 and the depth of the inside forming surface on the die member 54 in order that accepted standards for percentage reduction of the blank not be exceeded.

In accordance with the present invention, a method and apparatus for forming a drawn container by the draw-reverse draw process is provided wherein a blank of stock material is first drawn over the external surface of a stationary forming ring by a blanking punch to form a peripheral tubular wall portion. A drawing die, interiorly concentric with the blanking punch, is then caused to cooperate with a female forming die to draw the blank into the desired interior container configuration. During the latter drawing operation, the initially drawn tubular wall portion is completely redrawn from the exterior surface of the stationary forming ring and a peripheral portion thereof is disposed against an inner surface of the stationary forming ring. The female forming die and associated drawing die are then moved upwardly relative to a curling ring to form an inwardly curled bead peripherally of the upper open end of the container.

The aforenoted drawback in known apparatus and methods for producing drawn containers as disclosed in U.S. Pat. No. 3,695,084 is substantially eliminated by the method and apparatus of the present invention by the provision of the stationary forming ring external to and coaxial with the female forming die. The forming ring has an upper annular surface thereon which increases the diameter of the effective area over which the blank is initially drawn so that the desired percentage reduction is not exceeded. A greater reduction during the second or reverse redraw can thus be effected for a given finished upper diameter container size to produce a container having greater vertical depth than has heretofore been obtainable, while substantially keeping within the accepted limits of reduction.

Figure 2:
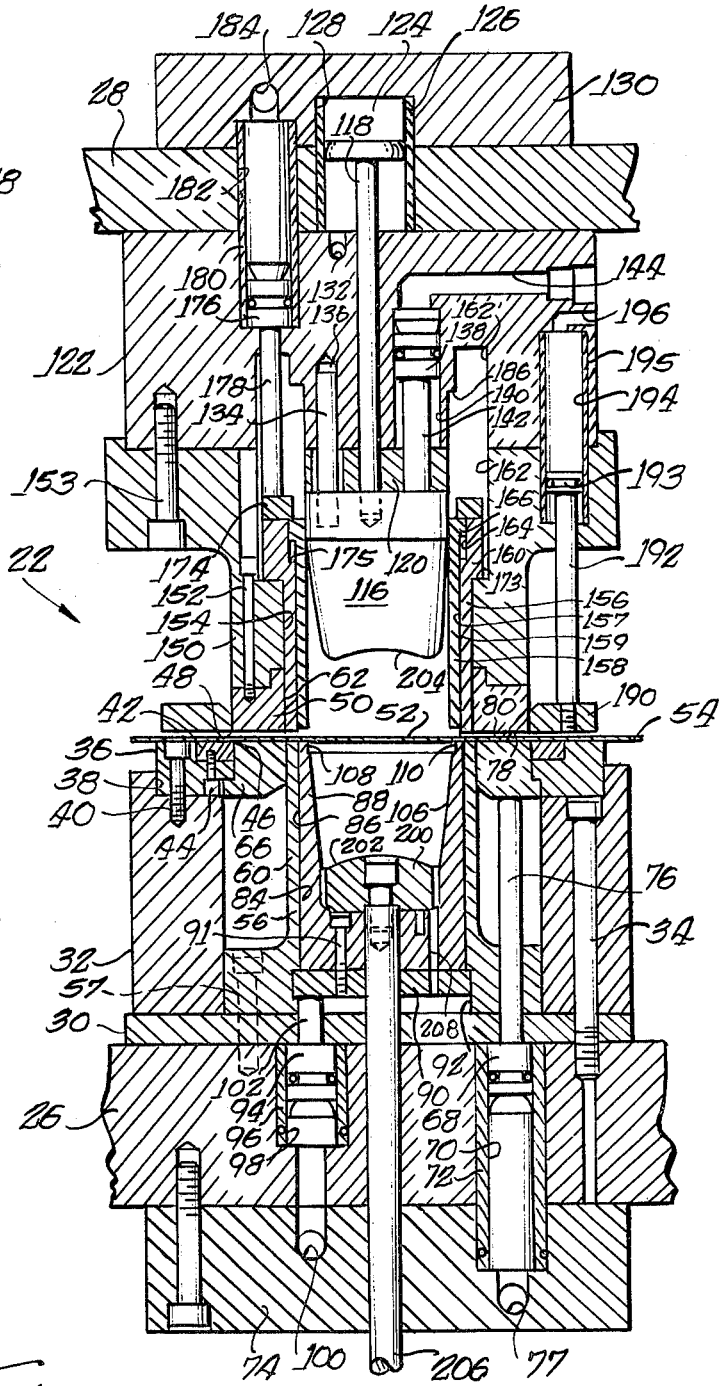
Figure 1A:
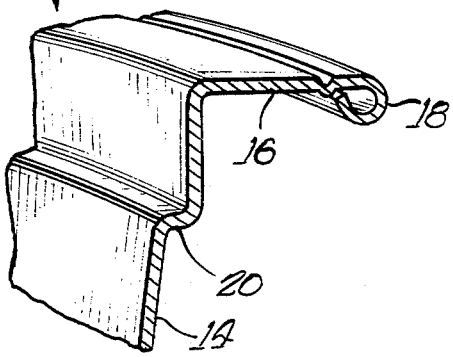
Figure 2A:
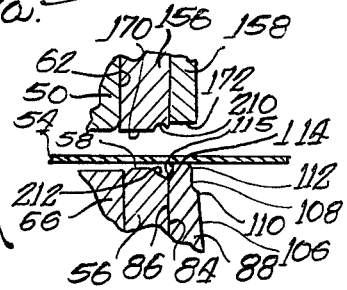
Figure 3:
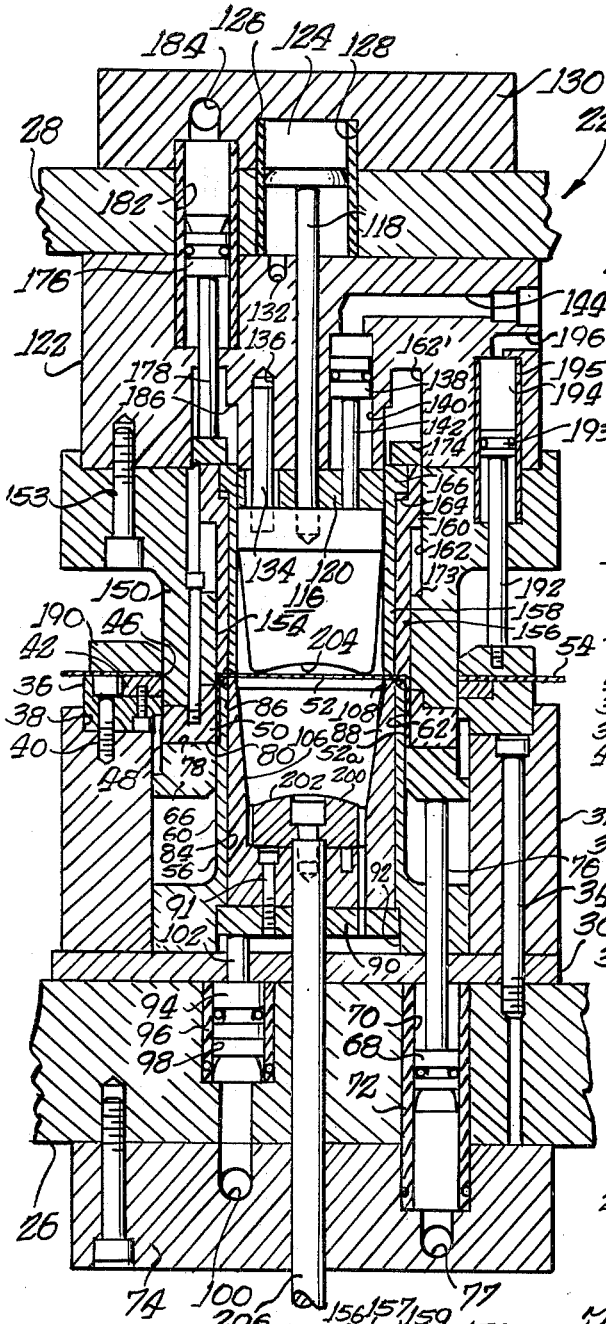
Figure 4:
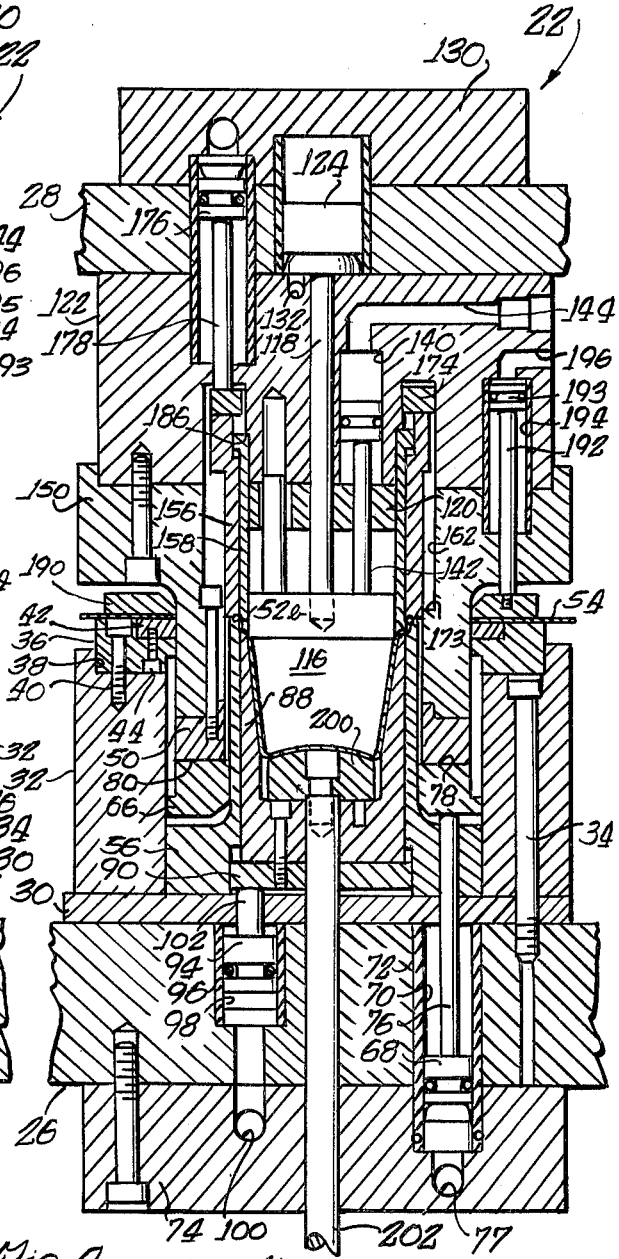
Figure 3A:
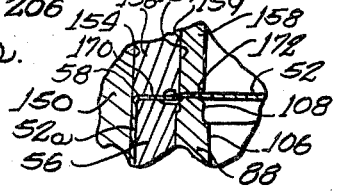
Figure 4A:
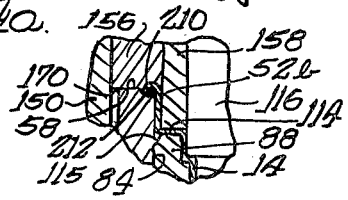
Figure 5:
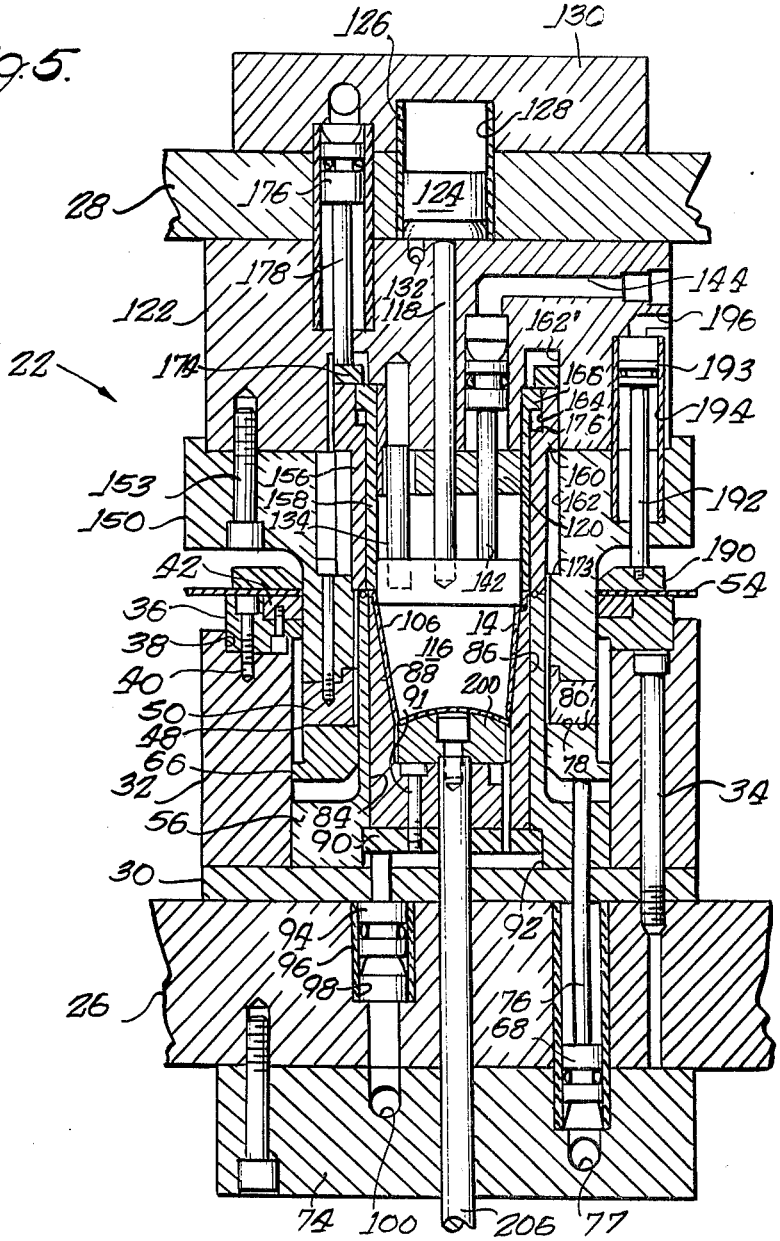
Figure 5A:
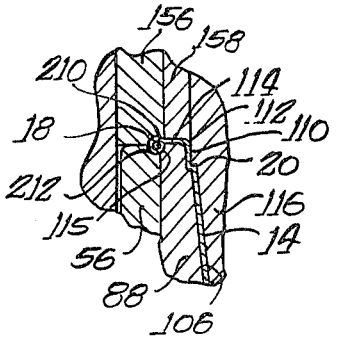

The various details and advantages of the present invention will become apparent from the following detailed description of the invention when taken in conjunction with the accompanying drawings wherein like reference numerals designate like elements throughout the several views, and wherein:

FIG. 1 is a perspective view of a container made in accordance with the method and apparatus of the present invention, a portion being broken away for clarity;

FIG. 1*a* is an enlarged perspective view of a portion of the container of FIG. 1 to illustrate the inwardly curled bead at the upper peripheral edge;

FIG. 2 is a partial longitudinal sectional view of a forming die set for making the container of FIG. 1, the die set being shown in a position just prior to cutting a blank from the sheet stock material;

FIG. 2*a* is an enlarged portion of the sectional view of FIG. 2 showing opposed edges of the forming die, drawing die, stationary forming ring and curling ring;

FIG. 3 is a partial longitudinal sectional view similar to FIG. 2 but showing the die set in a partially closed position with the blanking punch having cut a container blank and formed a tubular wall portion over the stationary forming ring;

FIG. 3*a* is an enlarged portion of the sectional view of FIG. 3 to show the blank clamped between the clamping ring and the forming die;

FIG. 4 is a partial longitudinal sectional view similar to FIG. 2 but showing the die set in a fully closed position wherein the tubular wall portion of the container blank has been redrawn;

FIG. 4*a* is an enlarged detail portion of the sectional view of FIG. 4 showing the upper peripheral edge of the redrawn side wall prior to forming the curled bead thereon;

FIG. 5 is a partial longitudinal sectional view similar to FIG. 2 but showing the die set after formation of a curled peripheral rim or bead on the container; and FIG. 5*a* is an enlarged detail portion of FIG. 5 showing the inwardly curled bead at the upper peripheral edge of the container.

Referring now to the drawings, and in particular to FIGS. 1 and 1*a*, a container made in accordance with the method and apparatus of the present invention is indicated generally at 10. The container 10 is preferably made of a suitable lightweight metal stock such as aluminum or aluminum alloy, although plastic may also be used, and includes a bottom floor 12 integral with an upwardly outwardly tapered peripheral wall 14 which terminates at its upper edge in a planar annular flange 16 having a peripheral curled rim or bead 18 at its outer edge. The method and apparatus of the invention are particularly useful in forming a deep drawn container 10 having a curled rim 18 to facilitate sealing of the container with a cover, although the invention is also useful in drawing shallow containers. The peripheral side wall 14 of the container 10 is formed with an annular stacking ring or ledge 20 spaced downwardly from the upper annular flange 16. The stacking ring 20 facilitates stacking of a plurality of the containers in nested relation with the lower frustoconical side wall portions in spaced relation so that the stacked containers may be readily separated.

FIGS. 2–5 are partial longitudinal sectional views showing various stages of operation of a die set, indicated generally at 22, of a forming press for forming drawn frustoconical shaped containers 10 in accordance with the present invention. Portions of the forming press which are not illustrated, such as the ram, crank shaft, and auxiliary support members, may be of any conventional configuration, and do not form part of the present invention.

The die set 22 includes a lower die holder block 26 and an upper die holder block 28. A backing plate 30 is positioned against the upper surface of the lower die holder block 26 and supports an annular yoke 32 which is secured to the backing plate by a plurality of circumferentially spaced screws, one of which is shown at 34, which engage the die holder block 26. An annular support member 36 is secured within an annular recess 38 on the yoke 32 by means of screws, one of which is indicated at 40. The support member 36 supports an annular female blanking die 42 through screws 44. In the illustrated embodiment, the female blanking die 42 has a circular inside cutting edge 46 which is cooperable with an external circular cutting edge 48 on annular die member means 50 for shearing or blanking sheet stock from which the container 10 is made. The die member 50 may be alternatively termed a blanking punch in that it cooperates with the female blanking die 42 to shear or cut a circular blank, such as indicated at 52 in FIG. 3, from flat material stock 54 which is progressively fed to the die set 22 by means (not shown) between each operating cycle of the die set when forming a container 10.

The lower die holder block 26 and backing plate 30 also support forming ring means in the form of a stationary annular forming ring 56 through screws 57 (FIG. 2). The stationary forming ring 56 has an upper annular clamping surface 58 (FIG. 2*a*) which is substantially coplanar with the upper cutting edge 46 on the blanking die 42. The forming ring 56 has a cylindrical outer forming surface 60 over which a portion of the blank 52 is formed by the die member 50 when moved downwardly over the stationary forming ring and will be described more fully below. The die member 50 has an inner cylindrical surface 62 having a diameter greater than the diameter of the outer cylindrical surface 60 of the stationary forming ring 56 by a distance equal to the thickness of the sheet material 54.

An annular draw ring 66 is slidable over the outer cylindrical surface 60 of the stationary forming ring 56 and is movable along the forming ring by means of one or more hydraulically or pneumatically actuated pistons 68. Each piston 68 is longitudinally slidable within an associated cylinder 70 defined by a liner 72 disposed within a suitable bore formed in the lower die holder block 26 and a porting block 74 secured to the lower surface of the die holder block 26. Each piston 68 has an upwardly extending piston rod 76 the upper end of which abuts the lower surface of the annular draw ring 66 for moving the draw ring relative to the stationary forming ring 56 as explained hereinafter. Preferably, six circumferentially spaced cylinders 70 and associated pistons 68 are provided in the lower die holder block 26 and porting block 74, with the cylinders 70 being connected to a source of hydraulic or pneumatic fluid pressure (not shown) through a port 77 in the porting block 74 for effecting selective movement of the annular draw ring 66. As shown in FIG. 2, preparatory to forming a container 10 the annular draw ring 66 is positioned such that its upper surface 78 is coplanar with the upper surface on the blanking die 42. In this manner, the upper surface 78 of the draw ring 66 is cooperable with a lower planar surface 80 on the male die member or blanking punch 50 to firmly grasp the full periphery of the blank 52 during shearing of the blank from the sheet stock 54.

The stationary forming ring 56 has an inner cylindrical surface 84 which slidingly receives the outer cylindrical surface 86 of a forming die 88. A circular limiter plate 90 is secured to the lower surface of the forming die 88 by a plurality of screws, one of which is indicated at 91. The limiter plate 90 is received within a suitable recess 92 in the lower end of forming ring 56 and limits movement of the forming die 88 between an upper position, as shown in FIGS. 2, 3 and 5, and a lower position as shown in FIG. 4. The forming die 88 is maintained in its upper position relative to the forming ring 56 by one or more hydraulic or pneumatically operated pistons 94 each of which is received within the cylindrical chamber of a liner 96 disposed within a cylindrical bore 98 formed in the lower die holder block 26. Each bore 98 is ported to a suitable source of fluid pressure and associated control means (not shown) through a port 100 so as to facilitate selective movement of the pistons 94 and associated piston rods 102 to upper positions moving the forming die 88 to its upper position relative to the forming ring 56, or allow downward movement of the limiter plate 90 and forming die 88.

The forming die 88 has an internal frustoconical surface 106 coaxial with its outer cylindrical surface 86. An internal cylindrical surface 108 and an annular transverse shoulder surface 110 are formed at the upper end of the forming die 88 to form the stacking ring 20 on the container 10. The internal cylindrical surface 108 terminates at its upper edge in a rounded edge surface 112 contiguous to an upper clamping surface 114 on the forming die 88. The plane of the clamping surface 114 is disposed slightly above the plane of the end surface 58 on the forming ring 56 when the forming die 88 is disposed in its upper position relative to the forming ring, as shown in FIG. 2. The forming die 88 has an external annular recessed surface 115 adjacent the upper end surface 114 to facilitate forming of the curled rim 18 on the container 10, as will be described hereinafter. As used herein, the forming die 88 is termed the first forming die means of the die set 22.

The interior frustoconical surface 106 and cylindrical surface 108 on the forming die 88 are cooperative with a forming punch 116 carried by the upper punch holder 28 to form the peripheral wall 14 and stacking ring 20 of the container 10. To this end, the forming punch 116, which may alternatively be termed a drawing die, is secured on the lower end of a piston rod 118 which is slidably received through suitable axially aligned bores in a backing plate 120 and a support block 122 and has its upper end secured to a piston 124. The piston 124 is slidable within the bore of a sleeve 126 disposed within a cylindrical chamber 128 formed in the upper die holder block 28 and an associated upper block member 130. The cylinder 128 is connected to a source of fluid pressure (not shown) through a port 132 to facilitate movement of the forming punch 116 to its upper position as shown in FIGS. 2 and 3. At least one guide pin 134 is secured to the forming punch 116 and is received upwardly within a guide bore 136 in the support block 122 to maintain the forming punch in fixed rotational position relative to the upper die holder block 28.

Downward movement of the forming punch 116 is effected by one or more pistons 138 each of which is received within a cylinder 140 in the support block 122 and has a piston rod 142 the lower end of which abuts the forming punch. The cylinders 140 are ported to a suitable source of fluid pressure through ports 144 in the support block 122 so that the pistons 138 and 124 may be coordinated by a control system (not shown) to effect the desired downward movement of the forming punch 116 relative to the upper die holder block 28.

The die member or blanking punch 50 is secured to an annular die support 150 by screws 152. The die support 150 is mounted on the support block 122 through screws 153. The die support 150 has an inner cylindrical surface 154 of equal diameter to the inner cylindrical surface 62 of die member 50 and is concentric with the forming punch 116. An annular curling ring 156 and an annular clamping member 158 are mutually slidable relative to each other and are coaxially disposed between the die member 50 and associated die support 150 and the forming punch 116. The mutually slidable inner and outer cylindrical surfaces 157 and 159 on the curling ring 156 and clamping member 158, respectively, have smaller diameters than the diameter of the outer cylindrical surface 86 on the forming die 88 by an amount equal to approximately twice the thickness of the blank material 54 to facilitate curling of the torroidal rim or bead 18 on the container 10 as will become more apparent below.

The curling ring 156 has an enlarged diameter annular portion 160 at its upper end which is slidable along or slightly spaced from cylindrical surfaces 162 and 162' formed in the die support member 150 and support block 122, respectively. An inner cylindrical recessed surface 164 at the upper end of curling ring 156 slidably receives an enlarged diameter annular portion 166 on the upper end of the clamping member 158. The curling ring 156 has an annular clamping surface 170 on its lower end which is coplanar with the lower surface 80 on the die member 50 when the curling ring is disposed in its lowermost position relative to the die support member 150, as shown in FIG. 2. The clamping member 158 has a planar clamping surface 172 on its lower end which is disposed slightly above the plane of the clamping surface 170 on the curling ring 156 when the curling ring is disposed in its uppermost position relative to the curling ring as in FIG. 2.

An annular ring member 174 is cooperative with the curling ring 156 and clamping member 158 to facilitate their positioning relative to the die member 50. When the upper die holder block 28 is spaced above the lower die holder block 26 as in FIG. 2, the enlarged portion 160 of the curling ring 156 abuts an annular stop surface 173 within the die support 150. In this condition, the clamping member 158 is disposed in an upper position relative to the curling ring 156 so that the annular portion 166 abuts the annular ring 174. Downward movement of the clamping member 158 relative to the curling ring 156 is limited by engagement of the annular portion 166 on the clamping member with an annular stop surface 175 formed on the curling ring 156.

To effect a controlled clamping pressure of the clamping surfaces 170 and 172 on the blank 52 against the underlying clamping surfaces 58 and 114, respectively, at least one control piston 176 is provided which has a piston rod 178 the lower end of which engages the annular ring 174. The piston 176 is slidable within the bore of a liner 180 received within a cylindrical bore 182 formed in the support block 122 and upper die support block 28. The bore 182 is connected to a source of fluid pressure (not shown) through a port 184 to control the upward movement of the curling ring 156 and clamping member 158 relative to the die member 50 as the upper die block 28 is moved downwardly, thus maintaining the desired clamping force between the opposed clamping surfaces 170, 58 and 172, 114 during operation.

The chamber 162' in the support block 122 has an annular shoulder surface 186 adapted to engage the upper end of the clamping member 158 and effect downward movement of the clamping ring relative to the curling ring 156 during downward movement of die block 28, as will be described more fully hereinbelow.

An annular stripper plate 190 is supported by the upper support block 122 through one or more piston rods 192 each of which has a piston 193 slidingly received within a cylindrical chamber 194 defined by a sleeve 195 retained within the die support 150 and support block 122. Each cylinder 194 is connected to a suitable source of fluid pressure through a port 196 to allow controlled movement of the stripper plate 190 relative to the support block 122. The piston rods 192, pistons 193 and associated fluid pressure controls (not shown) for port 196 are selected to position the lower surface of the stripper plate 190 slightly below the surface 80 on the die member 50 when the elements of the die set 22 are positioned to allow advancing of the stock 54, as in FIG. 2, maintain a predetermined clamping force against the sheet stock 54 during forming of a container 10 and insure stripping of the stock from the die member 50 after each cycle of the die set 22.

The lower die holder 26 includes means to effect ejection of a formed container 10 from the forming die 88 after a forming operation. To this end, an ejector block 200 is disposed within the forming die 88 and has an upper convex surface 202 which cooperates with a concave surface 204 of similar curvature within the forming punch 116 to form the bottom floor 12 of the container 10. The ejector block 200 is supported on the upper end of an actuating rod 206 which is operable by means (not shown) to effect upward movement of the ejector block 200 relative to the forming die 88 to effect ejection of a container formed within the forming die. An air passage 208 is provided in the forming die 88 and limiter plate 90 to allow escape of air during forming and prevent the creation of a vacuum during ejection of a container as would inhibit ejection.

The operation of the die set 22 to form a container 10, including the forming of the annular curled bead 18, will now be described. FIG. 2 shows the position of the die set elements at the beginning of the forming cycle wherein the upper die holder block 28 and the lower die holder block 26 and the associated forming elements carried thereby are separated and a sheet of stock material 54, such as aluminum sheet, has been fed therebetween.

After feeding the stock material between the separated lower die holder and upper punch holder, the press crank shaft (not shown) is caused to rotate causing the upper die holder block 28 and the elements supported thereon to move downwardly toward the lower die holder block 26 to begin the drawing operation. For purposes of illustration, FIGS. 2–5 show the lower die holder block 26 as being stationary and the upper die holder block as reciprocating up and down during each stroke of the press. At the beginning of the cycle, the draw ring 66 is maintained in its upper position as shown in FIG. 2 by means of the pistons 68 and associated piston rods 76. As the upper die holder 28 moves downwardly, the stripper plate clamps the stock 54 against the blanking die 42, and the clamping surfaces 170 and 172 clamp the stock against the annular surfaces 58 and 114, respectively, on the stationary forming ring 56 and forming die 88.

Continued downward travel of the upper die holder causes the blanking punch or die member 50 to punch or shear the blank 52 from the sheet stock 54 while moving the draw ring 66 downwardly, the latter movement being enabled by control means (not shown) associated with the fluid pressure supply to port 77 in a conventional manner. In shearing the blank 52 from the sheet stock 54, the die member 50 acts as blanking punch means.

As seen in FIG. 3, continued downward movement of the upper die holder 28 and die member 50 relative to the stationary forming ring 56 draws an annular portion of the blank 52 downwardly over the forming ring to form a tubular wall portion 52*a* of the blank between the inner surface 62 of the die member 50 and the outer forming surface 60 of the stationary forming ring 56. In drawing the tubular wall portion 52*a*, the die member 50 acts as second forming die means. It will be understood that during drawing of the tubular wall portion 52*a* of the blank 52, the fluid pressure acting on the pistons 176 and 193 is reduced sufficiently to allow upward movement of the curling ring 156, clamping member 158, and stripper plate 190 relative to the die support 150.

After the tubular wall portion 52*a* has been drawn over the outer cylindrical surface of the stationary forming ring 56, the forming punch or drawing die 116 is caused to move downwardly relative to the upper die holder block 28 by means of the pistons 138 and associated piston rods 142 under the influence of fluid pressure through port 144. The forming punch 116 is moved to its full downward position simultaneously with movement of the upper die holder block 28 downwardly to its lowermost position. During this movement, the forming punch 116 engages the central portion of the blank 52 and forms a reverse drawn open ended container against the inner frustoconical forming surface 106 and cylindrical forming surface 108 on the forming die 88, with the bottom wall 12 of the container being formed between the convex surface 202 on the ejector block 200 and the concave surface 204 on the forming punch 116. Simultaneously, the tubular wall portion 52*a* of the blank 52 is reverse drawn between the opposed clamping surfaces 58, 170 and 114, 172 to a position as shown in FIGS. 4 and 4*a* wherein a reverse redrawn annular wall portion 52*b* of the peripheral edge of the redrawn blank is disposed between the outer cylindrical surface of the clamping member 158 and the inner forming surface 84 on the stationary forming ring 56. The cooperating opposed surfaces 58, 170 and 114, 172 define annular forming passages through which the tubular wall portion 52*a* is reverse drawn. At this stage, the stacking ring 20 and annular flange 16 of the container 10 have been formed as shown in FIG. 4*a*. It will be noted that during this reverse draw step, the clamping ring 158 is moved downwardly relative to the curling ring 156 through engagement of the upper end of the clamping ring with the annular shoulder surface 186 on the support block 122, and the forming die 88 is moved downwardly relative to the stationary forming ring 56 by engagement of the clamping ring 158 with the upper surface 114 on the forming die 88.

After having reverse drawn the container blank 52 to the configuration as shown in FIG. 4, the forming die 88 is moved upwardly relative to the stationary forming ring 56 by fluid pressure applied to the pistons 94, it being understood that fluid pressure is applied to the pistons 124 and 138 in a manner to enable a corresponding upward movement of the forming punch 116. During upward movement of the forming die 88 to its uppermost position relative to the forming ring means 56, the upper free edge of the previously formed reverse redrawn annular wall portion 52*b* of the container blank is caused to engage an annular curling surface 210 on the lower inner end of the curling ring 156, the curling surface 210 being generally semi-circular in transverse cross section and contiguous to the inner cylindrical surface 157 on the curling ring. As noted above, the diameter of the inner cylindrical surface 157 on the curling ring 156 is less than the diameter of the outer forming surface 86 on the forming die 88 by an amount equal to approximately twice the thickness of the blank 52. Thus, upward movement of the wall portion 52*b* relative to the curling ring 156 causes the upper free edge of 52*b* to engage the curling surface 210 and effect a downward and radially inward curling of the wall portion 52*b* in cooperation with a curling surface 212, formed on the inner upper corner edge of the forming ring 56, and the aforenoted recessed surface 115 on the forming die 88 to form an annular bead or rim 18 on the container 10 as shown in FIG. 5*a*. After forming the bead or rim 18 peripherally of the container as shown in FIG. 5*a*, the forming die 88 and cooperating clamping ring 158 are caused to move further upwardly relative to the forming ring 56 and curling ring 156 until the upper surface of the formed annular flange 16 of the container is flush or coplanar with the uppermost surface of the bead 18, as best seen in FIG. 1*a*. Thereafter, the upper die holder 28 is raised to separate the lower and upper die holder blocks sufficiently to allow ejection of the container 10 by the ejector block 200 and manual or mechanical removal of the container from the die set 22. The upper die holder elements are then returned to their positions as shown in FIG. 2 preparatory to forming another container 10 during the next cycle of operation.

The method of forming a container 10 from a substantially planar blank 52 of material carried out with the die set 22 in accordance with the present invention is briefly summarized as follows. The blank 52 is first sheared or punched from the sheet stock 54 by cooperation of the die member 50 and the blanking die 42. A portion of the blank 52 is drawn between the stationary outer forming surface 60 of the forming ring 56 and the inner surface 62 of the die member 50 to establish the drawn tubular wall portion 52*a*. The tubular wall portion 52*a* is then totally reverse redrawn from the forming surface 60 through a forming passage defined by the opposed surfaces 58 and 170 on the forming ring 56 and curling ring 156, respectively, while the forming punch 116 substantially simultaneously forms the reverse drawn open ended container having a reverse redrawn annular wall portion 52*b* as best seen in FIGS. 4 and 4*a*. The reverse redrawn annular wall portion 52*b* extends generally axially of the reverse drawn open ended container in an opposite direction from the first formed tubular wall portion 52*a* which has now been completely reverse redrawn. Thereafter, the curled rim 18 is formed at the upper free edge portion of the redrawn annular wall 52*a* to form the rim or bead peripherally of the open end of the final formed container. The rim 18 is curled downwardly toward the bottom floor 12 of the container 10 exteriorly of the annular side wall 14 and is further curled radially inwardly toward the upstanding annular side wall 14. The resulting container 10 is then ejected by the ejector block 200.

As noted hereinabove, accepted standards of drawing limit the percentage reduction to which a blank can be safely drawn in each subsequent draw. The limit of reduction for each subsequent draw is expressed as a percentage of the diameter of the article following the previous drawing operation. The limits of reduction thus restrict the depth to which a container may be drawn in a second draw. By providing the stationary forming ring 56 with its upper clamping surface 58, the present invention increases the effective diameter over which the blank 52 is first drawn in forming the tubular wall portion 52*a* over what the diameter would be if the blank 52 were drawn directly over the outer surface 86 of the die member 88. The diameter of the blank 52 remaining after the first draw (formation of the tubular wall 52*a*) thus increases the amount of draw that may be effected during the second draw for a given final cup diameter. In this manner, the container 10 of the present invention may be drawn to a greater vertical depth than reverse drawn containers formed on dies wherein the tubular wall formed during the first draw is formed directly over an outer forming surface on a female forming die having an upper surface of a diameter substantially equal to the final diameter of the cup being formed. Having thus described a preferred embodiment of an apparatus and method for forming a draw-reverse draw container in accordance with the present invention, it will be understood that changes and modifications may be made in the apparatus and method without departing from the invention in its broadest aspects. Various features of the invention are defined in the following claims.

What is claimed is:

1. Apparatus for making a container from a blank of material, comprising, in combination, forming ring means defining inner and outer forming surfaces, first forming die means coaxially slidable along said inner forming surface of said forming ring means, said first forming die means having an inner forming surface, second forming die means, means supporting said second forming die means and said forming ring means for relative movement therebetween, said second forming die means being cooperative with said outer forming surface of said forming ring means to draw a portion of said blank into a tubular wall about said outer forming surface, a forming punch coaxial with said second forming die means and disposed interiorly thereof, means supporting said forming punch for movement relative to said first and second forming die means, said forming punch being cooperable with said forming die means to redraw said tubular wall from about said outer forming surface and form a reverse drawn open ended container having a reverse redrawn annular wall portion disposed in engagement with said inner surface of said forming ring means, clamping ring means concentric with said forming punch and having an annular clamping surface thereon cooperative with said first forming die means to engage said blank between said clamping ring means and said first forming die means, control means facilitating movement of said clamping ring means and first forming die means relative to said forming ring means so as to form an annular flange circumferentially of said reverse redrawn container contiguous to said reverse redrawn annular wall portion, curling ring means externally concentric with said clamping ring means, means for moving said clamping ring means and said first forming die means and associated reverse drawn annular wall portion relative to said curling ring means, said curling ring means having an annular curl forming surface thereon adapted to engage the annular free edge of said redrawn annular wall portion and form a downwardly and inwardly curled rim peripherally of the open end of the formed container during said movement of said redrawn annular wall portion relative to said curling ring means.

2. Apparatus as defined in claim 1 wherein said inner and outer surfaces on said forming ring means comprise concentric cylindrical surfaces, said second forming die means comprising an annular die member coaxially movable over said outer cylindrical surface of said forming ring to draw said portion of said blank into said tubular wall between said outer surface of said forming ring means and said annular die member.

3. Apparatus as defined in claim 1 wherein said curling ring means comprises an annular curling ring member coaxial with said forming ring means and having an inner cylindrical surface of a smaller diameter than said inner cylindrical surface of said forming ring means, said curling ring member having a curling surface thereon, said curling ring member and said forming ring means being relatively movable between a position wherein said curling ring member is axially spaced from said forming ring means and a position engageable with said free edge of said reverse drawn wall portion to form said peripheral rim.

4. Apparatus as defined in claim 1 wherein said forming ring means has an annular clamping surface thereon, said curling ring means having an annular holding surface which is cooperable with said clamping surface to engage said blank therebetween and define a forming passage through which said tubular wall is redrawn during forming of said reverse drawn open ended container.

5. Apparatus as defined in claim 1 including an annular draw ring supported concentrically of said forming ring means, said second forming die means being cooperable with said draw ring to shear said blank from a sheet of stock material prior to forming of said drawn container from said blank.

6. Apparatus for making a container from a blank of metallic material, comprising, in combination, forming ring means defining inner and outer forming surfaces and an annular clamping surface, blanking die means externally of said forming ring means and coaxial therewith, said blanking die means defining a blank support surface substantially coplanar with said clamping surface on said forming ring means, first forming die means coaxially slidable along said inner forming surface of said forming ring means, said first forming die means having an inner forming surface, second forming die means coaxial with said forming ring means, means supporting said second forming die means and said forming ring means for relative movement therebetween so that said second forming die means can move coaxially and longitudinally over said outer forming surface of said forming ring means, said second forming die means being cooperative with said outer forming surface of said forming ring means to draw a portion of said blank into a tubular wall about said outer forming surface when said second forming die means is moved in a first direction relative to said forming ring means, a forming punch, means supporting said forming punch interiorly of said second forming die means for coaxial movement relative to both said first and second forming die means, said forming punch being movable in said first direction relative to said first forming die means and cooperable with said first forming die means to redraw said tubular wall from about said outer forming surface and form a reverse drawn open ended container having a reverse redrawn annular wall portion disposed in engagement with said inner surface of said forming ring means, and curling ring means concentric with said forming punch, said curling ring means and said first forming die means being relatively movable toward each other and so that said curling ring means engages the annular free edge of said redrawn annular wall portion and forms a curled rim peripherally of the open end of the formed container, said rim being curled inwardly and downwardly relative to the bottom floor of the formed container.

7. A method of making a container from a blank of metallic material of predetermined diameter, comprising the steps of: drawing said blank over an external cylindrical surface on a forming ring having a first predetermined diameter so as to form a drawn container having a substantially planar portion of said predetermined diameter and a cylindrical annular wall portion, engaging an annular portion of said planar portion between a clamping ring applied exteriorly against said annular portion and an opposed forming die applied interiorly against said annular portion, reverse redrawing said annular wall portion between said clamping ring and forming die to form a reverse redrawn container having a bottom floor and an annular flange formed between said opposed clamping ring and forming die, said reverse redrawing simultaneously forming a redrawn annular wall generally normal to the plane of said annular flange and having a diameter less than said first diameter, said redrawn annular wall having a free edge portion, and curling said free edge portion of said annular wall outwardly and downwardly relative to said bottom floor and then inwardly toward said redrawn annular wall to form a curled rim circumferentially of an upper open end of the container.

8. The method of claim 7 including the step of shearing the blank of material from a sheet of material by a shear edge on said die member prior to drawing said portion of said blank into said drawn tubular wall portion.

9. The method of claim 8 including the step of clamping said sheet material peripherally of said shear edge simultaneously with shearing said material.

10. The method as defined in claim 22 wherein said curled rim is formed by engaging said free edge portion of said annular wall by a curling ring and effecting relative movement between said annular wall and said curling ring in a direction to form said curled rim while simultaneously retaining said annular flange in engaged relation between said clamping ring and said opposed forming die, said relative movement between said annular wall and said curling ring being sufficient to form said rim so that its uppermost edge does not extend above the plane of said annular flange with said container in an upright position.

* * * * *

UNITED STATES PATENT AND TRADEMARK OFFICE

CERTIFICATE OF CORRECTION

PATENT NO. : 4,051,707

DATED : October 4, 1977

INVENTOR(S) : John Valek, Roland E. Miller and Joseph A. Scaletta

It is certified that error appears in the above-identified patent and that said Letters Patent are hereby corrected as shown below:

Col. 4, line 7, "and" should be --as--.

Col. 12, Claim 10, line 1, "22" should be --7--.

Signed and Sealed this

*Sixth* Day of *June 1978*

[SEAL]

*Attest:*

RUTH C. MASON
*Attesting Officer*

DONALD W. BANNER
*Commissioner of Patents and Trademarks*